US005090320A

United States Patent [19]

Nave

[11] Patent Number: 5,090,320

[45] Date of Patent: Feb. 25, 1992

[54] SHOE PRINTING PROCESS AND APPARATUS

[76] Inventor: Bart I. Nave, Rt. 16, Box 397, Gray, Tenn. 37615

[21] Appl. No.: 498,532

[22] Filed: Mar. 26, 1990

[51] Int. Cl.[5] ..... B41F 17/00

[52] U.S. Cl. ..... 101/485; 101/35; 101/126; 101/41

[58] Field of Search ..... 101/3.1, 4, 9, 35, 41, 101/114, 126, 407.1, 483, 485; 269/48.1; 279/2 R

[56] References Cited

U.S. PATENT DOCUMENTS

| | | | |
|---|---|---|---|
| 1,128,225 | 2/1915 | Choate | 101/129 |
| 2,993,270 | 7/1961 | Broman | 269/48.1 |
| 3,837,632 | 9/1974 | Nelson | 269/48.1 |
| 4,548,825 | 10/1985 | Voss et al. | 101/35 |
| 4,612,856 | 9/1986 | Jennings | 101/35 |

FOREIGN PATENT DOCUMENTS

| | | | |
|---|---|---|---|
| 0099186 | 5/1987 | Japan | 101/41 |
| 0259854 | 11/1987 | Japan | 101/163 |

*Primary Examiner*—Edgar S. Burr
*Assistant Examiner*—Christopher A. Bennett

[57] ABSTRACT

The process for applying print matter to a flexible portion of a shoe, the process comprising providing a mandrel having a contact element provided with a substantially flat surface adapted to underlie and support the flexible portion under tension, positioning the shoe on the mandrel with the portion contacting under tension the surface and lying substantially flat thereon, and applying printing ink to the outer surface of the tensioned portion to leave printed matter thereon.

18 Claims, 3 Drawing Sheets

SHOE PRINTING PROCESS AND APPARATUS

This invention concerns the application of printed matter to shoes, particularly to a flexible portion thereof which is difficult to isolate in a proper printing plane, and especially concerns unique mandrel means for supporting such flexible portion in precise planar posture for the printing operation.

Heretofore, the application of printed matter, i.e., lettering, logo, emblem or the like to the flexible fabric or sheet material portions of casual shoes, sneakers, athletic shoes or the like has involved the pre-printing of the portion thereof prior to the actual manufacture or assembly of the shoe. The accurate and esthetically pleasing printing of such portions, particularly of shoes which have uppers comprised of substantial portions of hard or thick materials such as leather, vinyl, heavy canvas or the like which are relatively inflexible, wherein the portion to be printed on is bordered thereby, is a very difficult operation. The hard materials typically intrude into the path of the printing head whether it be a printing screen, ink stamp, engraved roller, heat transfer printing head, or other printing means, and effect a non uniform, poor quality print, especially adjacent the juncture of the portion and the hard material where the juncture typically comprises a raised edge of the hard or thick material and the printing head is thus prevented from adequately contacting the adjacent portion to be printed.

Consequently, the decorating of such shoes is conventionally done by pre-printing or pre-embroidery of the fabric or sheet material as shown in U.S. Pat. Nos. 2,607,130; 3,906,642; Des. 238,216; and Des. 240,170. Such techniques obviously limit the customer choices of shoe decorations and, except for very large customers who can order large numbers of shoes decorated to order, prevents the ordinary consumer from expressing by, way of his shoes, his own personal decorative tastes.

Objects therefore, of the present invention are:

to provide a simple and readily available printing process for applying various printing inks, printing pastes or the like to flexible portions of shoes, particularly where said portions are bordered by raised edge segments of other materials such as leather, vinyl or canvas which are relatively inflexible and thick, whereby the consumer can select any lettering, decoration, logo, or the like according to his own tastes and have it applied by printing to any flexible portion of a completed shoe he desires at a minimum expense; and to provide apparatus, especially the shoe mandrel means thereof which is inexpensive to manufacture and easy to use for supporting the shoe in proper printing position with the portion of the shoe to be printed held in an isolated, planar posture for proper contact with the printing means.

These and other objects hereinafter appearing have been attained in accordance with the present invention which, in its process embodiment comprises the process for applying print matter to a flexible portion of a shoe, said process comprising providing mandrel means having contact means provided with substantially flat surface means adapted to underlie and support said portion under tension in an isolated printing plane, positioning said shoe on said mandrel means with said portion contacting under tension said surface means and lying substantially flat thereon, and applying printing ink to the outer surface of said tensioned portion to leave printed matter thereon.

In certain preferred embodiments:

(a) said printing ink is applied by impressing a patterned screen against said portion and forcing an ink paste therethrough onto said fabric;

(b) said portion is pressured against said surface means by tension forces operating on said portion and developed by said mandrel means being forced against inner surfaces of said shoe tending to expand the same; and (c) said contact means is adjustably positioned on said mandrel means according to shoe size and the flexible portion location on the shoe, to contact and support said portion with maximum flatness.

The apparatus embodiment of the invention is defined as apparatus for printing on a flexible portion of a shoe, comprising base means, mandrel means on said base means having body means insertable at least partially into a shoe, contact means on said body means provided with substantially flat surface means for supporting said portion in a tensioned, substantially planar manner, and printing means on said base means, said printing means and mandrel means being mounted on said base means in a manner to allow relative movement therebetween to bring said printing means into and out of engagement with said portion supported in printing position on said mandrel means.

In certain preferred embodiments:

(d) said body means and said contact means thereon are structurally cooperative to tension and force said flexible portion against said surface means to hold the same firmly in printing position thereon;

(e) said contact means is positionable in different locations on said body means, and cooperating fixing means are provided on said body and said contact means for securing said contact means in a desired location for the printing operation as dictated by the location on the shoe of the portion to be printed;

(f) said fixing means comprises a magnetic couple; and (g) said fixing means comprises a VELCRO couple of interlocking, flexible plastic, hook-like projections.

Other objects and preferred embodiments of the invention will become evident from the following drawings and description thereof, wherein.

Figures 1, 2:
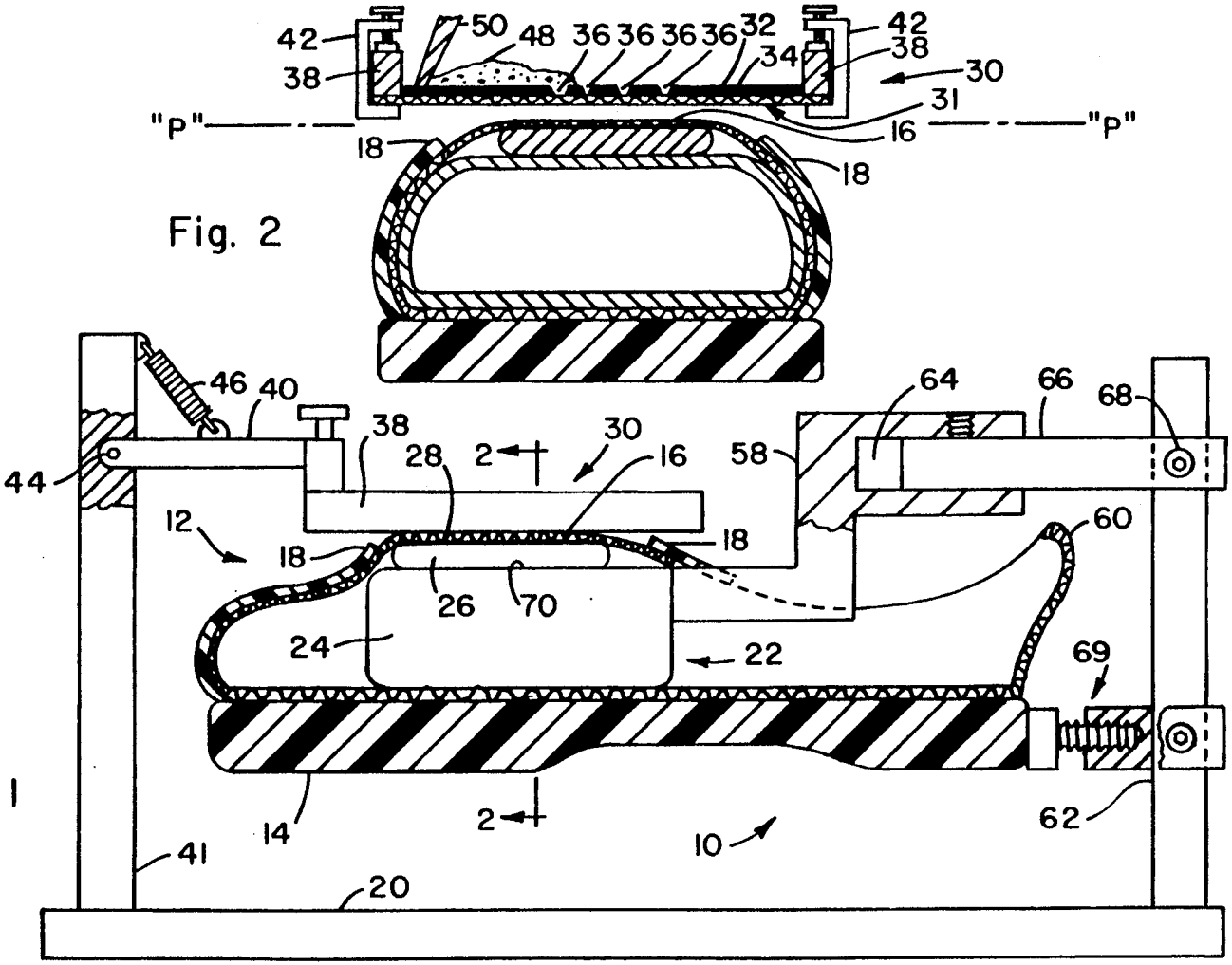
FIG. 1 is a side view with the shoe shown in longitudinal section and the mandrel means in side elevation.
FIG. 2 is a cross-sectional view taken along line 2—2 of FIG. 1 in the direction of the arrows, with the printing head shown lifted slightly above the shoe for drawing clarity.
Figure 3:
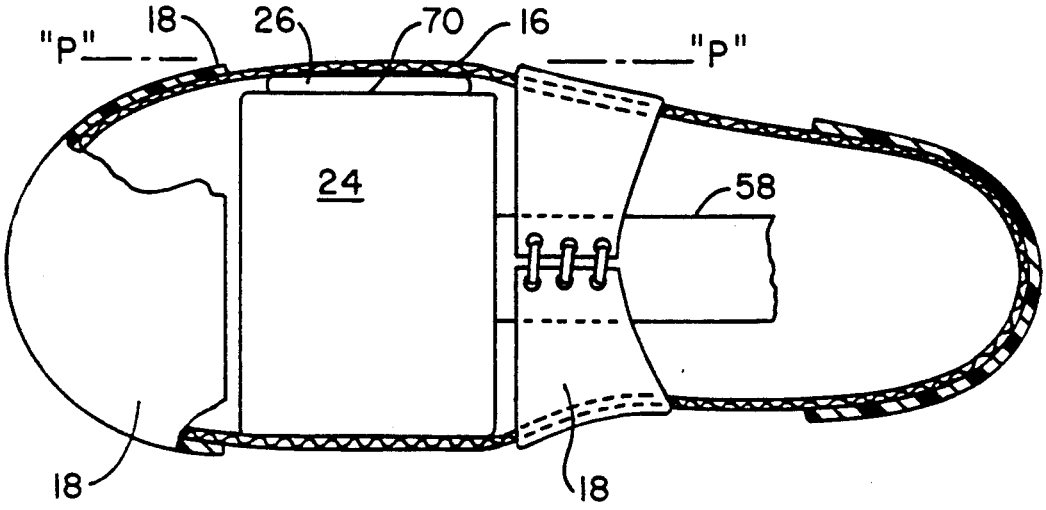
FIG. 3 is a partially cross-sectional view of a shoe mounted on a variation of the mandrel means of FIG. 1 which has been rotated 90 degrees for printing on a side area of the shoe.

Referring to the drawings, a shoe 10 to be printed or decorated comprises an "upper" generally designated 12 and a sole 14. The shoe can be of any type including running, tennis, beach, boot, basketball, or the like, wherein the upper has at least one flexible area or portion 18 of fabric or sheet material which can be printed on such as a polyamide, polyester, or cotton fabric or flexible vinyl sheet. As shown in FIGS. 1-3, such flexible areas in shoes are usually, but not necessarily, bordered by harder, less flexible, thick sections 18 of material such as supportive leather, vinyl, heavy canvas or the like. These sections, at their juncture with the aforesaid flexible areas, create a raised edge which normally prevents any type of printing device, especially a printing screen, from bearing properly on the area to be printed.

In the present apparatus however, such raised edges are effectively removed from the plane of the area to be printed. With reference to claim 5 hereof, the apparatus comprises base means 20, mandrel means 22 on said base means having body means 24 insertable at least partially into shoe 10, contact means 26 on said body means provided with substantially flat surface means 28 for supporting a flexible portion of said shoe in a tensioned, substantially planar manner, and printing means 30 on said base means, said printing means and mandrel means being mounted on said base means in a manner to allow relative movement therebetween to bring said printing means into and out of engagement with said flexible portion supported in printing position on said mandrel means.

Figure 9:
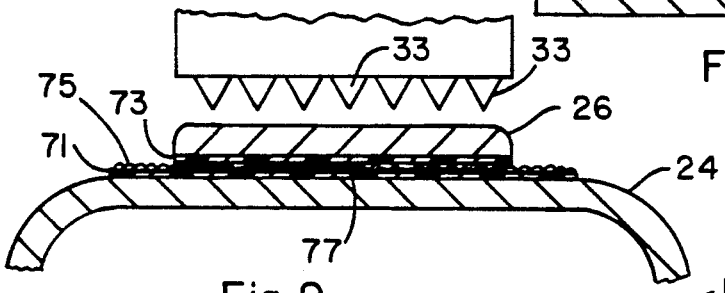
FIG. 9 is a cross-sectional view of the fixing means employing a typical VELCRO couple in a typical ink jet printer.

The particular printing apparatus on which the present mandrel means is supported can be of any type including ink jet means such as 33 shown in FIG. 9, and have any type or configuration of printing head as mentioned above, however the printing screen technique as shown is highly preferred from the standpoint of simplicity, flexibility of application to a variety of shoe sizes and configurations, and weight and variety of ink which can be applied in a controlled manner to the fabric.

Figure 10:
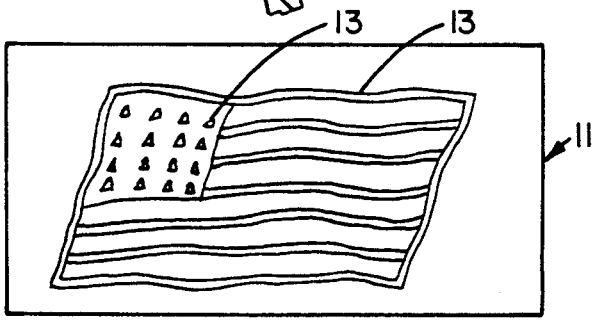
FIG. 10 is an elevational view of a typical patterned printing head.

Many types of printing apparatus including manually and automatically operating, are available and may be readily modified by one skilled in the art for carrying the printing head which may be, e.g., a metal or plastic plate such as 11 in FIG. 10 having raised printing portions or ridges 13 to which ink or paste can be applied in the manner of an ink stamp, but particularly a screen or screens and the present mandrel means. A few exemplary ones are shown in U.S. Pat. Nos. 4,438,893; 4,612,866; and 4,099,480, the disclosures of which are incorporated herein by reference. Also, a great variety of screen printing inks and pastes are known to the art for every type of fabric and the present invention is not limited in any way to any particular printing materials or shoe materials to which they may be applied. Exemplary ink materials and other details for screen printing useful herein are discussed in the textbook entitled *SCREEN PRINTING TECHNIQUES* by Albert Kosloff M.A., 3rd. Edition, The Signs Of The Times Publishing Co., Cincinnati, Ohio, Copyright 1981, incorporated herein by reference.

In the exemplary, and simplified apparatus as shown, the printing means or head 30 comprises a conventional printing screen 31, e.g., of Nylon fabric 32 coated with an ink impervious top coating 34 of photoresist material such as U.V. cured poly(methylmethacrylate) or the like, having an etched pattern 38 therethrough of the lettering or design to be printed. The Nylon is typically stretched across a wooden frame 38 which is affixed to suitable arm means such as 40 by thumb screw brackets 42 or equivalent structure. Arm 40 is typically pivotally mounted on a portion 41 of the base and is urged upwardly by means such as spring 48 to normally position the printing head or screen 31 above the mandrel means for allowing easy access thereto. When the shoe is properly positioned on the mandrel, the arm and screen are easily manually or mechanically pivoted downwardly to engage the screen with the shoe portion 18. The printing paste 48, of any conventional consistency or color, is then spread across the top of screen 31 by squeegee 60 or equivalent means such as a roller or the like to cause the paste to readily flow through the patterned apertures 38 onto portion 16 as shown in FIG. 1.

In the apparatus as shown, the mandrel 22 is shown affixed to an arm 58 which may be conveniently contoured or shaped as shown to accommodate the rear portion 80 of the shoe, but such is not critical since portion 60 is usually sufficiently flexible to allow arm 58 to extend straight to stanchion 62. Adjustment means for allowing the mandrel 22 to be easily rotated 90 degrees to its position as shown in FIG. 3, and also for horizontal adjustment for various length shoes, may be provided, e.g., by a square or otherwise keyed bore 64 in arm 58 and a mating support 66 which may conveniently be vertically slidably adjustable on stanchion 62, e.g., by set screw 68. Suitable threaded adjustable stop means 69 or the like may be provided on stanchion 82 to precisely position the shoe.

The present mandrel means which renders the present process and apparatus viable for achieving essentially faultless and highly pleasing shoe printing comprises the body 24 which can be given a variety of shapes and constructions as shown in FIG. 1-8, but which has a core construction which, upon insertion of the body into a shoe, can effect tensioning distortion of the shoe upper such as to isolate a flexible portion thereof into a printing plane, unencumbered by adjacent, raised sections of the shoe upper. This core construction comprises sections of the mandrel body which contact the inside of the shoe and tend to stretch the shoe upper, one of these body sections being a contact member such as 26 having the flat surface 28 which, in cooperation with the other said sections of the body distorts the shoe upper to isolate the portion 18 to be printed into an isolated printing plane "P" as shown in FIGS. 1-3.

The mandrel body as shown in FIGS. 1-3, may be a hollow, tubular, or solid block of any material including metal, wood, plastic, or ceramic and manufactured of various sizes and shapes to fit snugly into various size shoes. The body is preferably provided with at least one flat surface, e.g., 70, oversized with respect to contact means 26, such that where the contact means is not integral with the body but is a separate piece, it can be positioned on surface 70 in a selected location dictated by the specific location of the fabric area to be printed. The contact means, where it is not a permanent part of the mandrel body must be secured firmly in position thereon such that where the body is not of the expansible type shown in FIGS. 4–8, it will not be dislodged when the body is forced into the shoe. Such securement may be achieved, for example, by employing magnetic material for the construction of the body and contact piece, or providing the same with magnetic segments. It is preferred for such magnetic coupling that the adjacent surfaces of the body and contact piece be roughened such that the tendency for sliding of the piece on the body is minimized. Also, as shown in FIG. 9, the fixing means may be a VELCRO couple comprising the conventional base materials 71, 73 to which the interlocking hooks 75, 77 respectively are affixed.

Figure 4:
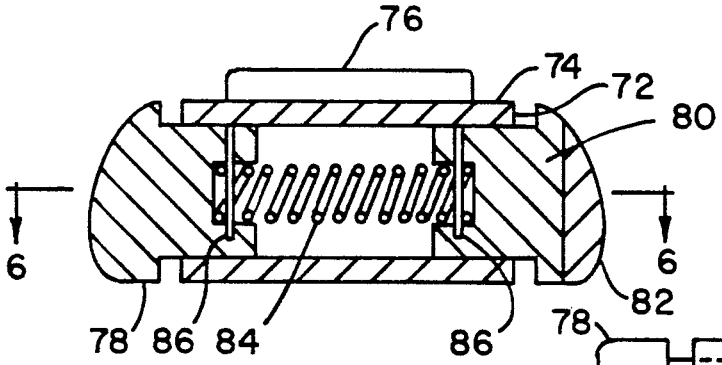
FIG. 4 is a lateral cross-sectional view of an expansible variation of the mandrel means.
Figure 5:
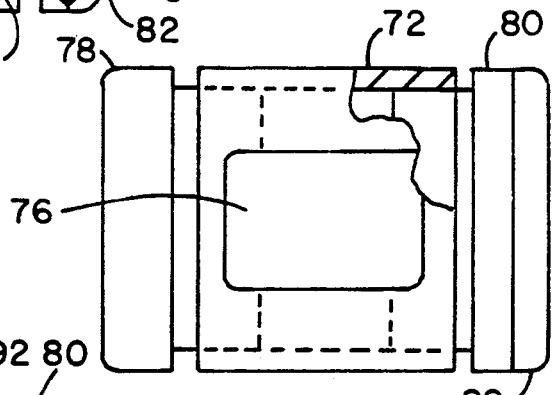
FIG. 5 is a top view cf the structure of FIG. 4.
Figure 11:
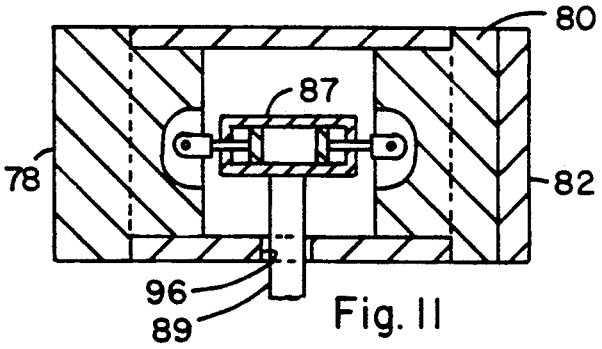
FIG. 11 is a cross-sectional view of the mandrel means employing a typical fluid cylinder for actuating the opposed pressure elements.

Referring to the variation of FIGS. 4 and 5, the mandrel body is comprised of a tubular magnetic iron segment 72 having a flat roughened surface 74 upon which a magnetic iron, roughened contact piece 78 can be positioned. Slidably mounted in this segment are opposed pressure elements 78 and 80 one or both of which may be provided with a removable and changeable contact piece 82 for specially fitting various size shoes. These slidable elements are continually urged apart by a spring 84 which is secured to each element by pins 86. Alternatively, these elements may be actuated into operable position by fluid cylinder means known to the art and exemplified in FIG. 11 as dual piston cylinder 87 having fluid inlet 89.

Figure 6:
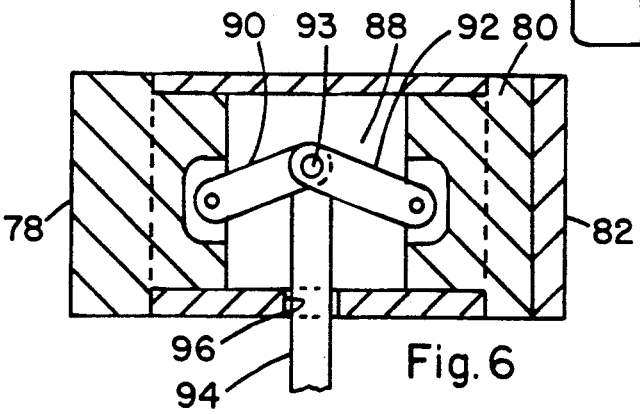
FIG. 6 is a cross-sectional view through line 6—6 of FIG. 4 showing a variation in the expansion means.

Referring to FIG. 6, the mandrel of FIG. 4 is provided with a mechanical expansion linkage 88 comprising link segment 90 and 92 pivotally connected by pin 93 to elements 78 and 80 respectively and to each other and actuator member 94 passing through an aperture 96 in tubular segment 72. Member 94 may be a rod or cable which can be pushed or pulled to release or apply outward force to the pressure elements.

Figure 7:
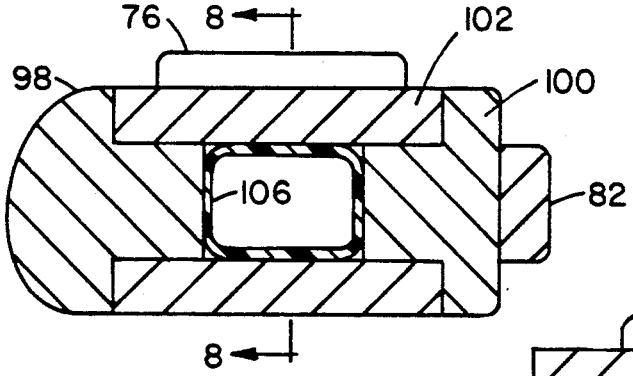
FIG. 7 is a cross-sectional view as in FIG. 4 of another variation of the mandrel and expansion means.
Figure 8:
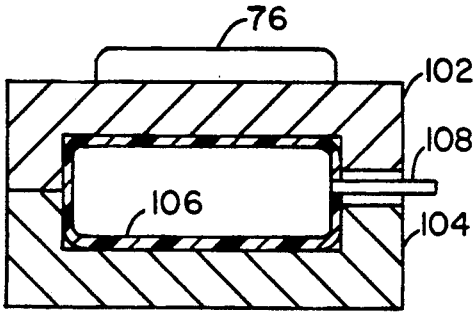
FIG. 8 is a view taken along line 8—8 of FIG. 7 in the direction of the arrows.

In FIGS. 7 and 8 a mandrel is shown comprising sliding pressure elements 98 and 100 mounted between the separable halves 102 and 104 of the mandrel body. An elastomeric bag 106 is adhesively attached to each of the sliding elements and halves and is provided with a suitable air port 108 and valve such as a conventional auto tire valve, not shown, whereby after the mandrel is properly positioned in the shoe, air can be injected into the bag to expand it and force the pressure elements and halves slightly apart to tension the fabric area to be printed tightly against contact piece 76. It is particularly noted that in this embodiment of the mandrel, force is applied to the mandrel body such as to move the contact piece 78 in a positive manner into tensioning contact with the fabric area to be printed.

As aforesaid the mandrel body can have any convenient configuration and, if desired, can be extended the full length of the shoe to allow the contact piece 26 or 76 to support shoe portions located anywhere on the shoe upper. Also, the shoe upper deforming forces can be applied longitudinally of the shoe, i.e., between the toe and heel to place the portion to be printed under tension across the surface 28 of the contact piece.

This invention has been described in detail with particular reference to preferred embodiments thereof, but it will be understood that variations and modification will be effected within the spirit and scope of the invention.

I claim:

1. The process for applying print matter to a flexible portion of a shoe upper, said flexible portion having inner and outer surfaces, said process comprising providing mandrel means having first contact means provided with substantially flat surface means adapted to underlie and support said flexible portion under tension, said mandrel means having second contact means spaced from and, in operative position, being substantially fixed with respect to said first contact means and adapted to contact an interior portion of said shoe lying generally opposite said flexible portion, positioning said shoe on said mandrel means with said flexible portion tensioned over said flat surface means and lying substantially flat thereon, and with said second contact means contacting said interior portion of said shoe under pressure to maintain said flexible portion under tension, and applying printing ink to said outer surface of said tensioned flexible portion to leave printed matter thereon.

2. The process of claim 1 wherein said printing ink is applied by impressing a patterned screen in a planar manner against said flexible portion and forcing an ink paste therethrough onto said flexible portion.

3. The process of claim 2 wherein said flexible portion is pressured against said flat surface means by tension forces operating on said flexible portion and developed by said mandrel means being forced against inner portions of said shoe tending to expand the same.

4. The process of claim 3 wherein said first contact means is adjustably positioned on said mandrel means according to shoe size and location of said flexible portion on the shoe, in order to contact and support said flexible portion with maximum flatness.

5. The process of claim 1 wherein said flexible portion is comprised of flexible fabric bordered by hard material having a raised edge, and wherein said ink is applied to said flexible portion adjacent said raised edge.

6. Apparatus for printing on a flexible portion of a shoe upper, comprising base means, mandrel means on said base means having body means insertable at least partially into a shoe cavity, first contact means on said body means provided with substantially flat surface means for supporting said flexible portion of said shoe upper which forms at least a portion of said cavity, second contact means on said body means spaced from and adapted to be, in its operative position, substantially fixed with respect to said first contact means and adapted to contact a portion of said shoe spaced from said flexible portion thereof, said first and second contact means adapted to forcibly deform said shoe upper by applying expansive forces to interior portions thereof to place said flexible portion in a tensioned, substantially planar condition substantially contiguous said flat surface means, and printing means on said base means, said printing means and mandrel means being mounted on said base means in a manner to allow relative movement therebetween to bring said printing means into and out of engagement with said flexible portion supported in printing position on said mandrel means.

7. The apparatus of claim 6 wherein said first contact means is positionable in different locations on said body means, and cooperating fixing means are provided on said body means and said first contact means for securing said first contact means in a desired location for the printing operation as dictated by the location on the shoe of the flexible portion to be printed.

8. The apparatus of claim 7 wherein said fixing means comprises a magnetic couple.

9. The apparatus of claim 7 wherein said fixing means comprises a VELCRO couple.

10. The apparatus of claim 6 wherein said body means comprises at least two relatively movable parts adapted to be urged apart by power means into forcible engagement with opposing inner portions of said shoe to place said flexible portion of said shoe under tension and substantially in engagement with said flat surface means.

11. The apparatus of claim 10 wherein said power means comprises spring means.

12. The apparatus of claim 10 wherein said power means comprises fluid cylinder means.

13. The apparatus of claim 10 wherein said power means comprises a fluid pressure expansible bag interposed between said relatively movable parts.

14. The apparatus of claim 13 wherein said bag is affixed to said relatively movable parts to maintain an extensible assembly thereof and to provide a retracting force to said parts upon decompression of said bag.

15. The apparatus of claim 6 wherein said printing means comprises a patterned printing screen.

16. The apparatus of claim 6 wherein said printing means comprises a patterned printing head.

17. The apparatus of claim 6 wherein said printing means comprises an ink jet printer.

18. The process for applying print matter by means of a substantially planar, screen printing means to the outer surface of a flexible portion of a shoe upper, comprising, supporting said shoe in a position for printing, said supporting including contacting the inner surface of said flexible portion with a substantially flat first surface portion of a mandrel means, contacting a generally opposed inner portion of said shoe with a second surface portion of said mandrel means, said first and second surface portions being substantially fixed with respect to each other such as to apply expansive forces to said flexible portion and said opposed inner portion, said contacting generating a tensioning force on said shoe upper causing said flexible portion to assume a substantially flat configuration substantially against and conforming to said substantially flat surface portion of said mandrel means, and brining said printing means into printing contact with said outer surface of said flexible portion to apply print matter thereto.

* * * * *